US011820144B2

(12) United States Patent
Tanaka

(10) Patent No.: US 11,820,144 B2
(45) Date of Patent: Nov. 21, 2023

(54) LIQUID DISCHARGE HEAD

(71) Applicant: Brother Kogyo Kabushiki Kaisha, Nagoya (JP)

(72) Inventor: Taiki Tanaka, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 39 days.

(21) Appl. No.: 17/388,715

(22) Filed: Jul. 29, 2021

(65) Prior Publication Data

US 2022/0088928 A1 Mar. 24, 2022

(30) Foreign Application Priority Data

Sep. 24, 2020 (JP) ..... 2020-159234

(51) Int. Cl.
*B41J 2/14* (2006.01)

(52) U.S. Cl.
CPC ..... *B41J 2/14233* (2013.01); *B41J 2/1433* (2013.01); *B41J 2002/14241* (2013.01); *B41J 2002/14419* (2013.01); *B41J 2002/14491* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 10,173,422 | B2 | 1/2019 | Itayama | |
| 2006/0066689 | A1* | 3/2006 | Hori | B41J 2/161 347/68 |
| 2006/0254037 | A1* | 11/2006 | Kitahara | B41J 2/1612 29/25.35 |
| 2008/0186364 | A1* | 8/2008 | Sugahara | B41J 2/161 29/25.35 |
| 2011/0279552 | A1* | 11/2011 | Yoshida | B41J 2/14274 29/890.1 |
| 2017/0062696 | A1* | 3/2017 | Iida | B41J 2/1629 |
| 2018/0229501 | A1 | 8/2018 | Itayama | |

FOREIGN PATENT DOCUMENTS

| | | | |
|---|---|---|---|
| JP | 2008-229985 | A | 10/2008 |
| JP | 2018-130913 | A | 8/2018 |

* cited by examiner

*Primary Examiner* — Erica S Lin
(74) *Attorney, Agent, or Firm* — Banner & Witcoff, Ltd.

(57) ABSTRACT

There is provided a liquid discharge head including: a pressure chamber plate including a plurality of pressure chambers and a vibration film, a piezoelectric actuator, and a protective plate covering the plurality of piezoelectric elements. The plurality of piezoelectric elements include a piezoelectric layer that is common to the plurality of pressure chambers. A circular recess and an island-like piezoelectric layer residual part enclosed by the circular recess are provided in a portion of the piezoelectric layer overlapping with partition walls of the pressure chamber plate. A residual overlapping part of the protective plate overlaps in a thickness direction with the island-like residual part, and is pressed on the island-like residual part of the piezoelectric actuator.

12 Claims, 6 Drawing Sheets

LIQUID DISCHARGE HEAD

CROSS REFERENCE TO RELATED APPLICATIONS

The present application claims priority from Japanese Patent Application No. 2020-159234, filed on Sep. 24, 2020, the disclosure of which is incorporated herein by reference in its entirety.

BACKGROUND

The present disclosure relates to liquid discharge heads discharging a liquid from nozzles.

There are publicly known liquid discharging heads discharging a liquid from nozzles such as an ink jet recording head jetting an ink from nozzles. In a publically publicly known recording head, on the upper surface of a flow channel formation substrate formed with a plurality of pressure generating chambers, a vibration plate is arranged to cover the plurality of pressure generating chambers aligning in one direction. Then, in such a part of the upper surface of the vibration plate as overlaps in the vertical direction with each pressure generating chamber, piezoelectric elements are arranged to apply a discharging energy to a liquid in the pressure generating chambers. Each piezoelectric element has a piezoelectric layer, and a first electrode and a second electrode arranged to interpose the piezoelectric layer in the thickness direction. Further, on the upper surface of the vibration plate, a protection plate is arranged to cover the plurality of piezoelectric elements which are accommodated in a piezoelectric element holder formed in the protection plate to extend in the one direction. In such a part of the protection plate as overlaps in the vertical direction with each partition wall between the pressure generating chambers of the flow channel formation substrate, a presser is formed to press the vibration plate on the partition walls, and those pressers are attached on the vibration plate with an adhesive. Because the pressers press the vibration plate on the partition walls, the pressure chambers' walls are improved in rigidity. By virtue of this, it is possible to suppress vibration transmission (crosstalk) between adjacent piezoelectric elements when they are driven.

SUMMARY

In the recording head mentioned above, the piezoelectric layers of the respective piezoelectric elements are connected to each other. The piezoelectric layers continuously extend in one direction. The parts of the piezoelectric layers overlapping in the vertical direction with the respective partition walls are removed. With the piezoelectric layers where the respective pressers formed integrally with the protection plate in the removed parts and, via the pressers, the protection plate is attached on the vibration plate. In this manner, consider that the pressers are formed integrally with the protection plate. For example, some attaching deviation may arise in the protection plate in the one direction. In such a case, a presser will approach one rather than the other piezoelectric element of the two piezoelectric elements corresponding to the two pressure generating chambers arranged to interpose a partition wall in the one direction. That is, such a problem arises in the area of the vibration plate facing a partition wall that a bias takes place in the position pressed by a presser to give rise to a variation in displacement of the piezoelectric element.

Accordingly, an object of the present disclosure is to provide a liquid discharge head configured to make the variation less likely to arise in displacement of the piezoelectric elements even if some attaching deviation occurs when the protection plate is attached to the vibration plate.

According to an aspect of the present disclosure, there is provided a liquid discharge head including a pressure chamber plate including a plurality of pressure chambers aligned in one direction, and a vibration film located at one side in a thickness direction orthogonal to the one direction and covering the plurality of pressure chambers; a piezoelectric actuator located on a surface of the vibration film at the one side in the thickness direction, and including a plurality of piezoelectric elements overlapping with the plurality of pressure chambers in the thickness direction; and a protective plate located on a surface of the piezoelectric actuator at the one side in the thickness direction, and covering the plurality of piezoelectric elements. The plurality of piezoelectric elements includes a piezoelectric layer extending in the one direction, the piezoelectric layer being common to the plurality of pressure chambers. The piezoelectric layer includes a circular recess and an island-like residual part which are located in a portion of the piezoelectric layer overlapping with partition walls in the thickness direction, each of the partition walls being located between the pressure chambers in the pressure chamber plate. The circular recess opens at the one side, at least part of the piezoelectric layer in the thickness direction is removed in the circular recess, and the circular recess surrounds the island-like residual part. An overlapping portion of the protective plate overlapping with the island-like residual part in the thickness direction is attached on the island-like residual part.

According to the liquid discharge head of the present disclosure, because the protective plate is pressed on the island-like residual part of the piezoelectric actuator, even if some attaching deviation occurs in the protection plate, positional deviation is less likely to arise in the vibration film pressed via the island-like residual part, thereby making the variation less likely to arise in displacement of the piezoelectric elements.

DETAILED DESCRIPTION

Hereinbelow, an embodiment of the present disclosure will be explained.

<An Overall Configuration of Printer 100>

Figure 1:
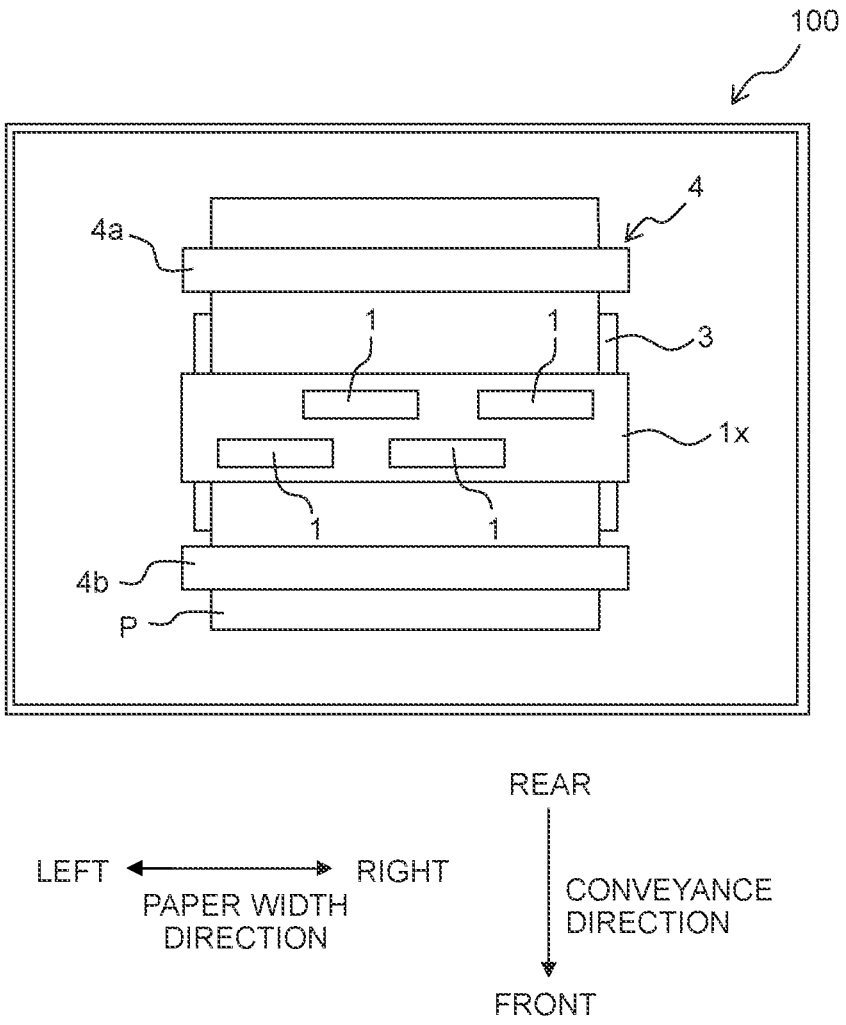
FIG. 1 is a schematic configuration diagram of a printer including an ink jet head according to an embodiment of the present disclosure.

As depicted in FIG. 1, a printer 100 according to this embodiment includes a head unit 1*x* having four ink jet heads 1 (the "liquid discharge head" of the present disclosure), a platen 3, and a conveyer 4.

The head unit 1$x$ is a so-called line head. The head unit 1$x$ is elongated in a horizontal paper width direction (the "one direction" of the present disclosure) to discharge an ink to paper P from a plurality of nozzles 22, with its position being fixed (see FIGS. 2 to 4). The four ink jet heads 1 are elongated respectively in the paper width direction. Further, two ink jet heads 1 align in the paper width direction. Further, the other two ink jet heads 1 are arranged to align in the paper width direction in positions deviating from the former two ink jet heads 1 in a conveyance direction (the "orthogonal direction" of the present disclosure) which is horizontal but orthogonal to the paper width direction. The four ink jet heads 1 are arranged zigzag along the paper width direction.

Note that as depicted in FIG. 1, the following explanation will be made with a definition of the right side and the left side in the paper width direction. Further, the following explanation will be made with a definition of the front side and the rear side in the paper width direction.

The platen 3 is arranged below the head unit 1$x$ to face the plurality of nozzles 22 of the four ink jet heads 1. The paper P is placed on the upper surface of the platen 3.

The conveyer 4 has two roller pairs 4$a$ and 4$b$ arranged to interpose the platen 3 in the conveyance direction. The roller pairs 4$a$ and 4$b$ rotate while nipping the paper P to convey the paper P in the conveyance direction.

<The Configuration of the Ink Jet Heads 1>

Next, the configuration of the ink jet heads 1 will be explained. As depicted in FIGS. 2 to 6, each ink jet head 1 has a flow channel unit 11, a piezoelectric actuator 12, a protective plate 13, and a wiring substrate 18.

Figure 3:
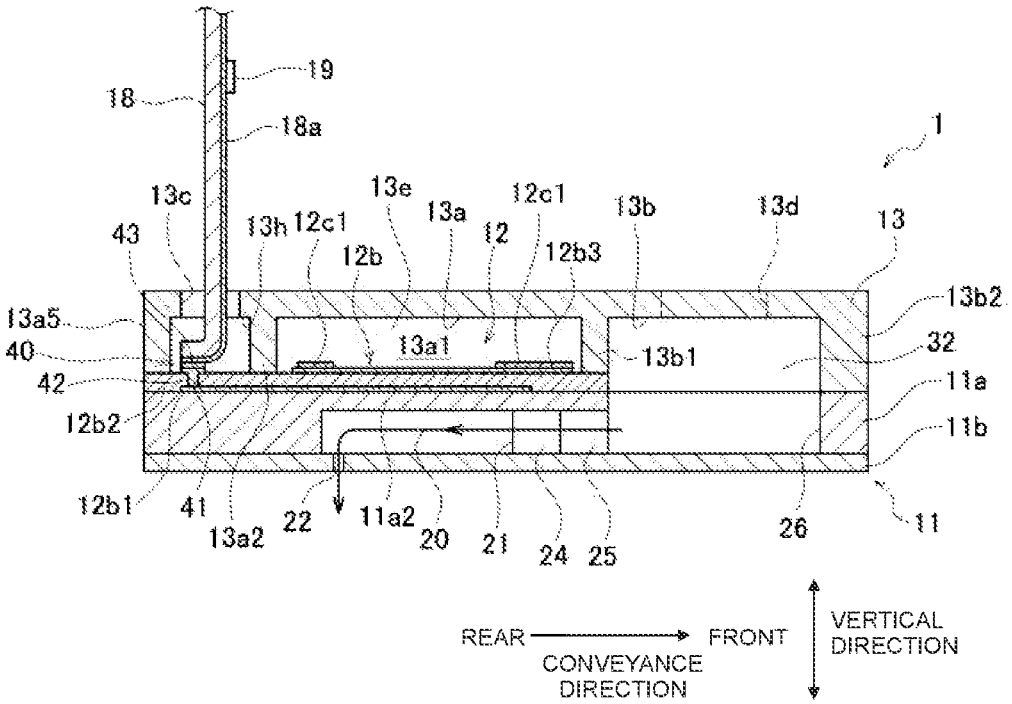
FIG. 3 is a cross section view along the line III-Ill of FIG. 2.

As depicted in FIG. 3, the flow channel unit 11 has a pressure chamber formation plate 11$a$ and a nozzle formation plate 11$b$. The plates 11$a$ and 11$b$ are stacked in the vertical direction (the "thickness direction" of the present disclosure), and attached to each other with an adhesive. The two plates 11$a$ and 11$b$ in this embodiment are silicon plate members but may be made of, for example, a resin or a metal such as stainless steel or the like. Further, a plurality of individual flow channels 20 are formed in the plates 11$a$ and 11$b$. Note that in this embodiment, the upper side in the vertical direction corresponds to the "one side in the thickness direction" of the present disclosure.

Figure 2:
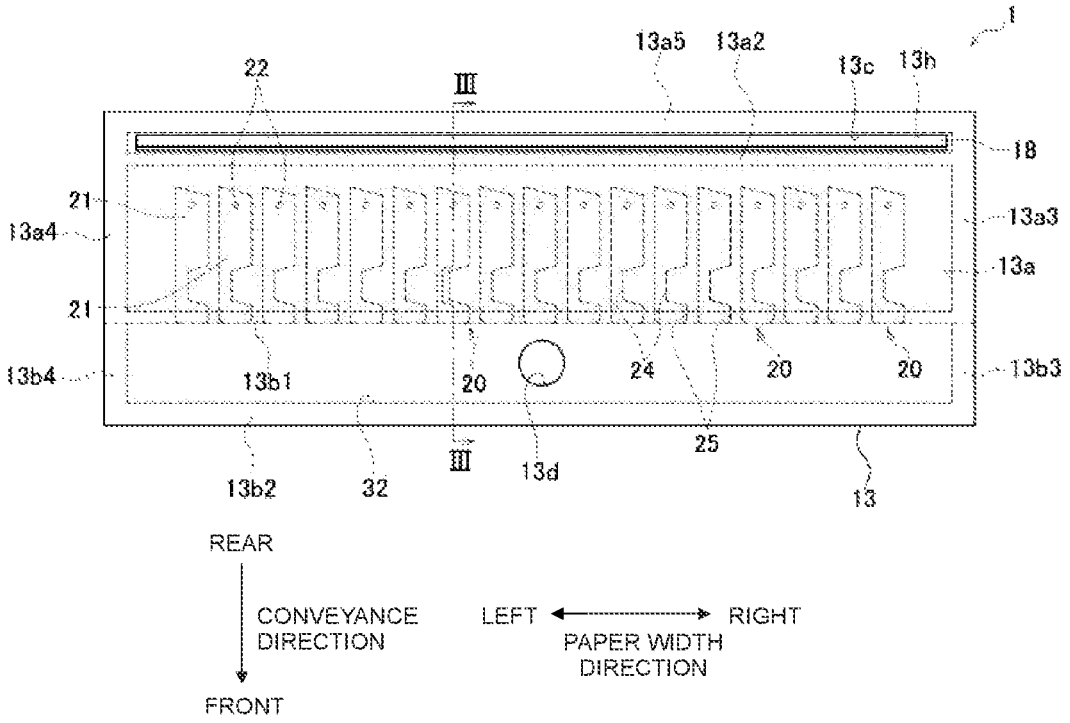
FIG. 2 is a plan view of the ink jet head of FIG. 1.

As depicted in FIGS. 2 and 3, the pressure chamber formation plate 11$a$ is formed with a plurality of pressure chambers 21, a plurality of narrow flow channels 24, a plurality of wide flow channels 25, and a communication part 26. The nozzle formation plate 11$b$ is formed with a plurality of nozzles 22. The plurality of individual flow channels 20 are arranged to align in the paper width direction. Each individual flow channel 20 has a pressure chamber 21, a nozzle 22, a narrow flow channel 24, and a wide flow channel 25.

The pressure chambers 21 are, as depicted in FIG. 2, almost rectangular and elongated in the conveyance direction in the shape thereof when projected in the vertical direction. Further, the plurality of pressure chambers 21 are arrayed in the paper width direction to form a pressure chamber array. A nozzle 22 is connected to an end of each pressure chamber 21 at one side in the conveyance direction whereas a narrow flow channel 24 is connected to the end at the other side in the conveyance direction. In this context, the one side in the conveyance direction refers to the rear side in the conveyance direction whereas the other side refers to the front side in the conveyance direction.

The narrow flow channels 24 are, as depicted in FIG. 2, narrower in width (shorter in the paper width direction) than the pressure chambers 21, to function as throttles. The center of each narrow flow channel 24 in the paper width direction is positioned on the left to the center of the corresponding pressure chamber 21 in the paper width direction.

The ends of the narrow flow channels 24 at the other side in the conveyance direction are connected to the wide flow channels 25. The wide flow channels 25 are almost as wide as (or almost as long in the paper width direction as) the pressure chambers 21. The center of each wide flow channel 25 is at the same position in the paper width direction as the center of the corresponding pressure chamber 21 in the paper width direction.

As depicted in FIG. 3, the pressure chamber 21, the narrow flow channel 24, and the wide flow channel 25 are formed by etching one surface (the lower surface in this case) of the pressure chamber formation plate 11$a$ (the "pressure chamber formation substrate" of the present disclosure), to construct the same with those recesses. The recesses open in the lower surface of the pressure chamber formation plate 11$a$.

Figure 5:
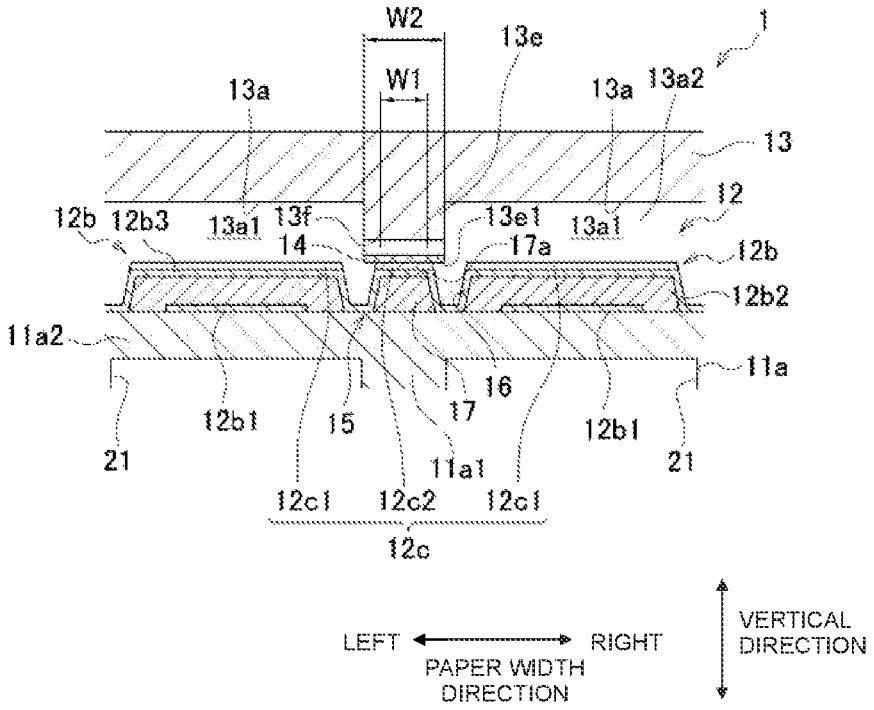
FIG. 5 is a cross section view of the key parts of the ink jet head at the position along the line V-V depicted in FIG. 4.

As depicted in FIG. 5, a partition wall 11$a$1 is formed between two adjacent pressure chambers 21 of the pressure chamber formation plate 11$a$ in the paper width direction, to partition the respective pressure chambers 21.

As depicted in FIG. 2, the communication part 26 is elongated in the paper width direction. As depicted in FIG. 3, the communication part 26 penetrates through the pressure chamber formation plate 11$a$ in the vertical direction and is connected with the ends of all wide flow channels 25 at the other side in the conveyance direction. Note that the communication part 26 is in communication with a recess 13$b$ of an aftermentioned protective plate 13, to construct a common flow channel 32 configured commonly for the respective pressure chambers 21.

As depicted in FIGS. 3 and 5, the pressure chamber formation plate 11$a$ has a vibration plate 12$a$. The vibration plate 12$a$ is formed by the upper end of the pressure chamber formation plate 11$a$ to cover the entire pressure chambers 21. A vibration film 11$a$2 is, for example, as thick as 10 μm or so.

The nozzles 22 are formed of through holes formed in the nozzle formation plate 11$b$. Further, the plurality of nozzles 22 form nozzle arrays aligned in the paper width direction. Each nozzle 22 is positioned in the center of the pressure chamber 21 in the paper width direction to overlap with the pressure chamber 21 in the vertical direction.

As depicted in FIG. 3, the piezoelectric actuator 12 has a plurality of piezoelectric elements 12$b$, an auxiliary electrode layer 12$c$. The piezoelectric elements 12$b$ are positioned below the auxiliary electrode layer 12$c$. The plurality of piezoelectric elements 12$b$ are formed on the upper surface of the vibration film 11$a$2 (the "surface at one side in the thickness direction" of the present disclosure). The piezoelectric elements 12$b$ are arranged on such parts of the vibration film 11$a$2 as to correspond to the respective pressure chambers 21, that is, on upper surfaces of the displacement parts. That is, the piezoelectric elements 12$b$ overlap in the vertical direction with the pressure chambers 21, respectively. The piezoelectric elements 12$b$ in this embodiment have the individual electrodes 12$b$1, the piezoelectric layer 12$b$2, and the common electrode 12$b$3. The piezoelectric elements 12$b$ is stacked on the individual electrodes 12$b$1, while the common electrode 12$b$3 is stacked on the piezoelectric layer 12$b$2. Each of the piezoelectric elements 12$b$ and common electrode 12$b$3 in this embodiment is as thick as 0.2 μm or so. The piezoelectric layer 12$b$2 is about 1.0 μm in thickness.

Figure 4:
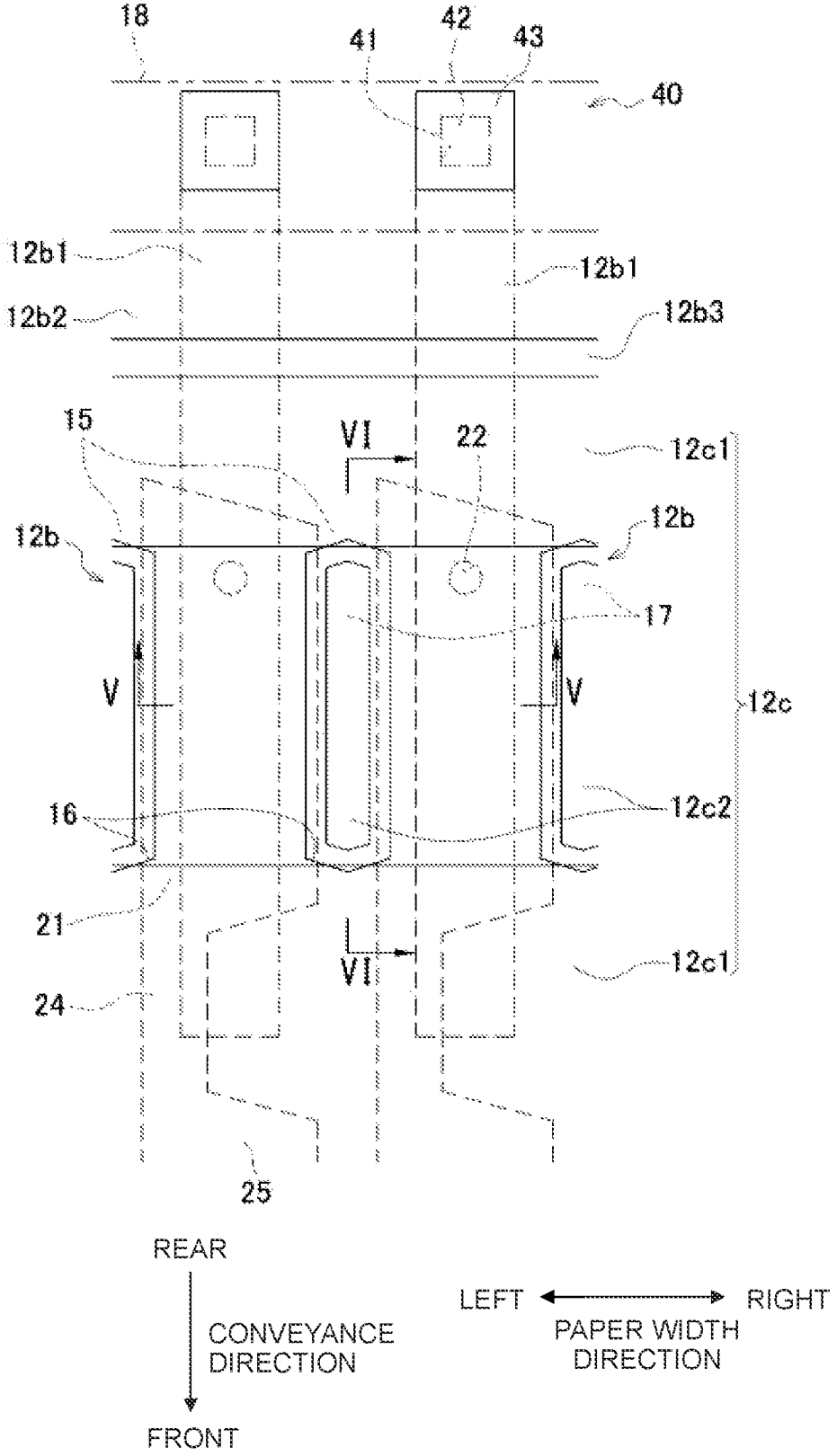
FIG. 4 is a plan view of key parts of a piezoelectric actuator.

As depicted in FIG. 4, the individual electrodes 12*b*1 are provided independently according to each pressure chamber 21. On the other hand, the common electrode 12*b*3 is provided continuously across the plurality of pressure chambers 21. In more detail, the width of the individual electrode 12*b*1 is, as depicted in FIGS. 4 and 5, formed narrower than that of the pressure chamber 21 in the paper width direction. Further, as depicted in FIG. 4, the front ends of the individual electrodes 12*b*1 extend up to positions overlapping in the conveyance direction with the narrow flow channels 24 beyond the ends of the pressure chambers 21 while the rear ends extend up to a connection electrode part 40 (to be described later on).

The common electrode 12*b*3 is belt-like and extends to be elongated along the paper width direction. The two ends of the common electrode 12*b*3 in the paper width direction is arranged outside of the outmost pressure chambers 21 constituting the pressure chamber array. As depicted in FIG. 4, the common electrode 12*b*3 extends in the conveyance direction such that, its front end exceeds the ends of the individual electrodes 12*b*1 to extend to the outside whereas its rear end exceeds the ends of the pressure chambers 21 to extend to an area between the pressure chambers 21 and the connection electrode part 40. The common electrode 12*b*3 of this embodiment is, as depicted in FIG. 5, also formed on aftermentioned recesses 16 and island-like residual portions 17. In this manner, the common electrode 12*b*3 included in the plurality of piezoelectric elements 12*b* is a common electrode whose respective parts are linked to each other.

Figure 6:
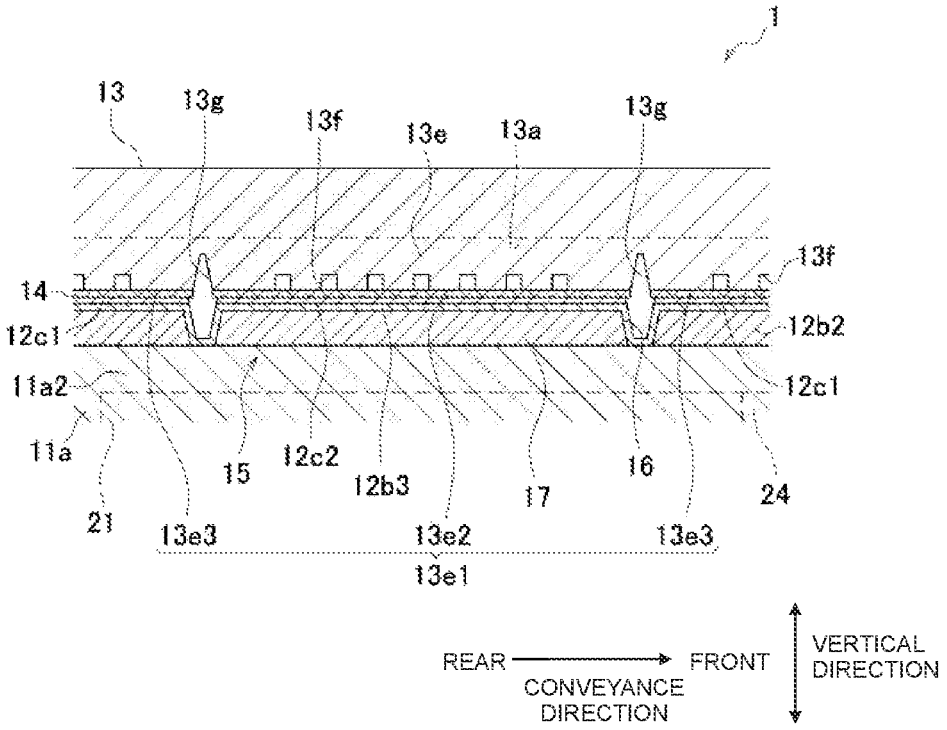
FIG. 6 is a cross section view of the key parts of the ink jet head at the position along the line VI-VI depicted in FIG. 4.

As depicted in FIG. 3, the piezoelectric layer 12*b*2 is formed to exceed the two ends of the pressure chambers 21 in the conveyance direction and extend to the outside while extending along the paper width direction across the plurality of pressure chambers 21. Then, as depicted in FIGS. 4 to 6, a circular recess 16 formed by partially removing the piezoelectric layer 12*b*2 is formed in each partition wall overlapping part 15 overlapping with the partition wall 11*a*1 of the piezoelectric layer 12*b*2 in the vertical direction. Further, an island-like residual portion 17 enclosed by the recess 16 is formed in each partition wall overlapping part 15. Those plurality of recesses 16 and island-like residual portions 17 are formed along the paper width direction at the same pitch as the formation pitch for the pressure chambers 21. In other words, between two adjacent recesses 16 and between two adjacent island-like residual portions 17, a piezoelectric element 12*b* corresponding to one pressure chamber 21 is formed at the same pitch as the formation pitch for the pressure chambers 21. Further, as depicted in FIG. 5, the width of the piezoelectric layer 12*b*2 on the pressure chambers 21 in the paper width direction is narrower than that of the pressure chambers 21 in the paper width direction but wider than that of the individual electrodes 12*b*1 in the paper width direction.

As depicted in FIG. 4, the recess 16 is shorter than the pressure chamber 21 in the conveyance direction. Further, the recess 16 is arranged for the two ends in the conveyance direction to locate on the inside of the two ends of the pressure chamber 21 in the conveyance direction. Further, the recess 16 is formed into an elongated thin hexagon along the conveyance direction according to planar view. In more detail, the recess 16 has an outer circumferential shape of a hexagon to have two sides parallel to the conveyance direction. Note that in the conveyance direction, the piezoelectric layer 12*b*2 is formed on the outside of the recesses 16 to be continuous across the plurality of pressure chambers 21. In other words, the common piezoelectric layer 12*b*2 included in the plurality of piezoelectric elements 12*b* extends along the paper width direction to link the parts thereof to each other.

As depicted in FIG. 4, the island-like residual portion 17 is formed into an elongated thin hexagon along the conveyance direction according to planar view, too. In more detail, the island-like residual portion 17 is similar to the recess 16 in outer circumferential shape on the upper surface of the piezoelectric layer 12*b*2 (the "surface at one side in the thickness direction" of the present disclosure). Then, in planar view, the island-like residual portion 17 and the recess 16 are concentric. In this manner, the island-like residual portion 17 is formed along the outer circumference of the recess 16. Further, as depicted in FIG. 5, the island-like residual portion 17 is as thick as the piezoelectric layer 12*b*2. That is, the island-like residual portion 17 has an upper surface 17*a* arranged at the same level as the upper surface of the piezoelectric layer 12*b*2 except that of the island-like residual portion 17.

As depicted in FIG. 5, the piezoelectric element 12*b* is sized in the area corresponding to the pressure chamber 21 according to the paper width direction in such a manner as to decrease in width in the order of the common electrode 12*b*3, the pressure chamber 21, the piezoelectric layer 12*b*2, and the individual electrode 12*b*1. Then, the area of the piezoelectric layer 12*b*2 interposed between the individual electrode 12*b*1 and the common electrode 12*b*3 acts as an active portion to give rise to piezoelectric distortion by way of applying a voltage to the two electrodes.

As depicted in FIG. 4, the auxiliary electrode layer 12*c* (the "auxiliary electrode" of the present disclosure) has two belt-like auxiliary electrode layers 12*c*1 extending along the paper width direction, and a plurality of island-shaped auxiliary electrode layers 12*c*2 formed on each island-like residual portion 17, on the two end parts of the plurality of piezoelectric elements 12*b* in the conveyance direction. In this embodiment, the belt-like auxiliary electrode layers 12*c*1 and the island-shaped auxiliary electrode layers 12*c*2 are also as thick as 0.2 μm, being almost the same as the respective electrodes 12*b*1 and 12*b*3. However, those sizes are merely exemplary so that the present disclosure is not limited to those sizes. The auxiliary electrode layer 12*c* is made of gold (Au) and stacked on the common electrode 12*b*3 via an unshown adhesion layer. The two belt-like auxiliary electrode layers 12*c*1 are arranged at the two opposite sides in the conveyance direction to interpose the plurality of recesses 16. By virtue of this, it is possible to raise the rigidity of the piezoelectric elements 12*b* in the area corresponding to the end parts of the pressure chambers 21 without too much suppressing the deformation of each piezoelectric element 12*b*. Further, it becomes possible to lessen the electric resistance in the path linking each piezoelectric element 12*b* and the common electrode 12*b*3. Note that on the outside according to the paper width direction, the auxiliary electrode layer 12*c* extends up to a terminal area siding the connection electrode part 40 (an aftermentioned area where a plurality of individual connection electrode layers 43 are formed; not depicted). Then, in the terminal area, the auxiliary electrode layer 12*c* is connected electrically with a common wire of the wiring substrate 18.

As depicted in FIG. 3, the connection electrode part 40 is formed on the piezoelectric layer 12*b*2 in an area at the rear side of the pressure chamber 21 in the conveyance direction. The connection electrode part 40 is formed with a through hole 41 from the upper surface of the piezoelectric layer 12*b*2 to the individual electrode 12*b*1. In the area corresponding to the through hole 41, an electrode for connection 42 is a little larger than the through hole 41. The electrode for connection 42 is patterned to correspond to the through hole 41, being in conduction with the individual electrode 12b1 via the through hole 41. Note that the individual electrode 12b1 is covered by the piezoelectric layer 12b2 except the area facing the through hole 41. By virtue of this, the leak electric current from the individual electrode 12b1 is suppressed as much as possible and, furthermore, it is possible to spare the labor of taking a special measure for suppressing the leak current (for example, a protecting measure by using a protector film such as aluminum dioxide or the like).

As depicted in FIG. 3, the protective plate 13 (the "protective plate" of the present disclosure) is, attached to the upper surface of the piezoelectric actuator 12 and the upper surface of the flow channel unit 11. The protective plate 13 in this embodiment is made of silicon but may be formed of, for example, a resin or a metal such as stainless steel or the like. The protective plate 13 has the same outer shape projected in the vertical direction as the pressure chamber formation plate 11a and the piezoelectric actuator 12, and overlaps completely in the vertical direction with the pressure chamber formation plate 11a and the piezoelectric actuator 12 in terms of the outer shape. The protective plate 13 is formed with a plurality of recesses 13a, 13b, and 13h and a plurality of through holes 13c and 13d by way of etching from the lower surface.

As depicted in FIG. 5, the plurality of recesses 13a are, provided individually for the plurality of piezoelectric elements 12b. Then, the plurality of recesses 13a align in the paper width direction. The accommodation space 13a1 formed by each recess 13a individually accommodates a piezoelectric element 12b. Because the recesses 13a is formed in the protective plate 13, the protective plate 13 is separated from such parts of the piezoelectric actuator 12 as overlap in the vertical direction with the pressure chambers 21 of the piezoelectric actuator 12. In this embodiment, the protective plate 13 is separated from the parts of the piezoelectric actuator 12 overlapping in the vertical direction with the pressure chambers 21 by a distance of about 10 μm. By virtue of this, when the piezoelectric elements 12b are driven, the protective plate 13 is less likely to affect the piezoelectric elements 12b through contact. Therefore, it is possible to suppress impeding the displacement of the piezoelectric elements 12b.

As depicted in FIG. 5, the part between adjacent recesses 13a of the protective plate 13 is a partitioning wall 13e partitioning two accommodation spaces 13a1. Each partitioning wall 13e (the "residual overlapping part" of the present disclosure) overlaps in the vertical direction with the island-like residual portion 17. Further, the partitioning wall 13e is formed to project from a lower part (the "other side in the thickness direction" of the present disclosure) than the bottom of the recess 13a (the part of the protective plate 13 overlapping in the vertical direction with the pressure chamber 21). As depicted in FIG. 6, the partitioning wall 13e extends to be elongated in the conveyance direction, and is longer than the recess 16 in the conveyance direction, where a lower surface 13e1 of the partitioning wall 13e is attached to the piezoelectric actuator 12 via an adhesive 14. In more detail, a central part 13e2 of the lower surface 13e1 (the "attachment surface" of the present disclosure) overlapping in the vertical direction with the island-like residual portion 17 is attached on the island-like residual portion 17 of the island-like residual portion 17 with the adhesive 14. Further, in the conveyance direction, such an outer part 13e3 of the lower surface 13e1 as outside of the central part 13e2 is attached on the outer part of the piezoelectric actuator 12 on the outside of the recess 16 of the piezoelectric layer 12b2 with the adhesive 14. In this manner, the partitioning wall 13e of the protective plate 13 is pressed on the island-like residual portion 17 of the piezoelectric actuator 12.

As depicted in FIGS. 5 and 6, the lower surface 13e1 of the partitioning wall 13e is formed with a plurality of ditches 13f for letting go the adhesive 14. These ditches 13f extend in the paper width direction and are aligned along the conveyance direction.

Further, the lower surface 13e1 of the partitioning wall 13e is formed with two cutouts 13g. These two cutouts 13g extend in the paper width direction in positions overlapping with the recesses 16 along the vertical direction. Further, the cutouts 13g are deeper (longer in the vertical direction) than the ditches 13f in the vertical direction. In this manner, the cutouts 13g are formed to lessen the amount of applying the adhesive 14 to the lower surface 13e1 for attaching the lower surface 13e1 to the piezoelectric actuator 12. Supposing that the cutouts 13g are not formed in the lower surface 13e1, then the adhesive 14 should also be applied to the parts of the lower surface 13e1 overlapping in the vertical direction with the recesses 16. If the protective plate 13 is pressed onto the piezoelectric actuator 12 and attached thereon under such condition, then the excessive adhesive is liable to flow into the recesses 16 and. In some cases, the excessive adhesive may come to stick to the parts of the piezoelectric actuator 12 overlapping with the pressure chambers 21 (the piezoelectric elements 12b). However, in this embodiment, because the cutouts 13g are formed in the lower surface 13e1, the amount of applying the adhesive 14 to the lower surface 13e1 is lessened such that it is possible to suppress the excessive adhesive. Note that the process of patterning by applying the adhesive 14 to the protective plate 13 is simpler than the process of patterning by applying the adhesive to the piezoelectric actuator 12 and the flow channel unit 11. Therefore, in this embodiment, the adhesive is applied to the protective plate 13 to attach the protective plate 13 to the piezoelectric actuator 12 and the flow channel unit 11.

As depicted in FIG. 5, the lower surface 13e1 of the partitioning wall 13e has a width W2 larger than a width W1 of the upper surface 17a of the island-like residual portion 17 in the paper width direction. In this manner, if the width W2 is larger than the width W1, then even though the protective plate 13 is attached to the piezoelectric actuator 12 with an attaching deviation in the paper width direction, then the range of allowing the attaching deviation is expanded as much as the difference between the widths W1 and W2. By virtue of this, it is pressed more readily on the island-like residual portion 17 of the piezoelectric actuator 12, compared to the width W2 being smaller than the width W1. Further, with the width W2 being larger than the width W1, it is possible for the partitioning wall 13e to press uniformly on the island-like residual portion 17 of the piezoelectric actuator 12.

As depicted in FIGS. 2 and 3, the plurality of recesses 13a of the protective plate 13 are defined by walls 13a2 to 13a4, 13b1, and 13e all of which are attached to the piezoelectric actuator 12. The wall 13a2 is arranged at a little rearward part from the center in the conveyance direction, while the wall 13b1 is arranged at a little frontward part from the center in the conveyance direction. These walls 13a2 and 13b1 extend along the paper width direction to link the walls 13a3 and 13a4. Further, the plurality of walls 3e are arranged along the paper width direction to extend along the conveyance direction to link the walls 13a2 and 13a1. The other walls 13*a*3 and 13*a*4 are arranged at the two opposite sides to extend along the conveyance direction. In this manner, with the walls 13*a*2 to 13*a*4 enclosing the outer circumferences of the plurality of recesses 13*a*, the plurality of piezoelectric elements 12*b* of the piezoelectric actuator 12 are enclosed. With the protective plate 13 having such a walling structure, the plurality of piezoelectric elements 12*b* of the piezoelectric actuator 12 are arranged in a sealed space (the plurality of accommodation spaces 13*a*1) which blocks up the plurality of piezoelectric elements 12*b* of the piezoelectric actuator 12 from the outside, such that oxidation due to the moisture in air is restrained.

As depicted in FIGS. 2 and 3, the recess 13*h* of the protective plate 13 extends to be elongated along the paper width direction. Part of the recess 13*h* of the protective plate 13 is defined by the walls 13*a*2 to 13*a*5. The wall 13*a*5 among those walls 13*a*2 to 13*a*5 is arranged at the rear end in the conveyance direction and attached to the piezoelectric actuator 12, all other aspects being the same as described above. Then, the through hole 13*c* is formed at the center of the part being the bottom of the recess 13*h* of the protective plate 13. Further, the through hole 13*c* extends in the paper width direction over the plurality of individual connection electrode layers 43 to overlap in the vertical direction with the plurality of individual connection electrode layers 43.

As depicted in FIGS. 2 and 3, the protective plate 13 is attached to cover the front part of the flow channel unit 11 in the conveyance direction. The recess 13*b* of the protective plate 13 extends to be elongated along the paper width direction. Further, the recess 13*b* is arranged to face the communication part 26 of the flow channel unit 11 such that a common flow channel 32 is constructed from the recess 13*b* and the communication part 26. Among the walls 13*b*1 to 13*b*4 defining the recess 13*b* of the protective plate 13, the above wall 13*b*1 arranged in the center in the conveyance direction is attached to the piezoelectric actuator 12, whereas the wall 13*b*2 arranged at the front side in the conveyance direction is attached to the flow channel unit 11. The other walls 13*b*3 and 13*b*4 arranged at the two opposite sides are attached to the flow channel unit 11. Then, as depicted in FIG. 2, in the center of the part being the bottom of the recess 13*b* of the protective plate 13, the through hole 13*d* is formed. The common flow channel 32 is in communication with an unshown sub tank via the through hole 13*d*. The sub tank is in communication with the main tank storing the ink to store the ink supplied from the main tank. The ink in the sub tank flows into the common flow channel 32 from the through hole 13*d*. The ink having flowed in the common flow channel 32 is supplied to each individual flow channel 20.

The wiring substrate 18 is made from a COF (Chip On Film) or the like as depicted in FIGS. 2 and 3, the lower end of which is attached to a rear end part of the upper surface of the piezoelectric actuator 12 in the conveyance direction. The lower end of the wiring substrate 18 extends in the paper width direction on the upper surface of the piezoelectric actuator 12 (see FIG. 4), having a plurality of individual wires 18*a* (see FIG. 3) electrically in respective connection with the plurality of individual connection electrode layers 43 and a common wire (not depicted). The individual wires 18*a* are provided according to each individual flow channel 20. The common wire is electrically connected with the common electrode 12*b*3 via the auxiliary electrode layer 12*c*. The common electrode 12*b*3 is connected electrically to an unshown power source via the common wire to keep itself at the ground potential or voltage.

The wiring substrate 18 extends upward from the upper surface of the piezoelectric actuator 12 through the through hole 13*c*, as depicted in FIG. 3, its upper end being connected to an unshown control substrate. Further, a driver IC 19 is mounted on the wiring substrate 18.

The driver IC 19 is electrically connected with the individual electrodes 12*b*1 via the individual wires 18*a*. The driver IC 19 generates a drive signal on the basis of a control signal from the unshown control substrate. By applying the drive signal to the individual electrodes 12*b*1, the individual electrodes 12*b*1 are switched between a predetermined potential and the ground potential. By virtue of this, the parts of the vibration film 11*a*2 and piezoelectric layer 12*b*2 overlapping in the vertical direction with the pressure chambers 21 are deformed to change the volume of the pressure chambers 21. By virtue of this, a pressure is applied to the ink in the pressure chambers 21 to discharge the ink from the nozzles 22.

As described above, according to the ink jet heads 1 of this embodiment, by forming the circular recess 16 in each partition wall overlapping part 15 of the piezoelectric layer 12*b*2 overlapping in the vertical direction with the partition wall 11*a*1, it is possible to break up the link of the piezoelectric layers 12*b*2 between adjacent piezoelectric elements 12*b*. Therefore, the partition wall parts 15 are reduced in restraining when each piezoelectric element 12*b* is driven to deform such that it is possible to increase the driven deformation amount of each piezoelectric element 12*b*.

In addition to that, the partitioning walls 13*e* of the protective plate 13 are pressed on the island-like residual portions 17 of the piezoelectric actuator 12 enclosed by the circular recesses 16. That is, the partitioning walls 13*e* are pressed on the partition walls 11*a*1 between the pressure chambers 21 via the island-like residual portions 17. By virtue of this, the rigidity of the circumferential wall of each pressure chamber 21 increases such that it is possible to suppress the crosstalk due to the vibration transmission to the pressure chambers 21 corresponding to another piezoelectric element 12*b* adjacent to one piezoelectric element 12*b* when the one piezoelectric element 12*b* is driven. Further, the part of the piezoelectric actuator 12 overlapping in the vertical direction with the partitioning wall 13*e* is interposed between the partitioning wall 13*e* and the partition wall 11*a*1 between the pressure chambers 21, thereby being less likely to deform. Therefore, the partitioning wall 13*e* brings about a less likelihood of transmitting the deformation of the part of the piezoelectric actuator 12 overlapping in the vertical direction with the one pressure chamber 21 to the other pressure chamber 21 adjacent to the one pressure chamber 21. That is, it is possible to further suppress the crosstalk by the transmission of the deformation of the piezoelectric actuator 12 in the part overlapping in the vertical direction with the pressure chamber 21 constituting one individual flow channel 20 to the part of the pressure chamber 21 constituting the other individual flow channel 20.

Then, according to the ink jet heads 1 of this embodiment, because the partitioning walls 13*e* of the protective plate 13 are pressed on the island-like residual portions 17 of the piezoelectric actuator 12, even if some of the attaching deviation occurs between the protective plate 13 and the piezoelectric actuator 12, the vibration film 11*a*2 pressed via the island-like residual portions 17 is still less likely to deviate in position. Consider a case where the partitioning walls 13*e* press the vibration film 11*a*2 without the island-like residual portions 17 being formed. For example, in case even only a little attaching deviation occurs in one paper width direction between the protective plate 13 and the pressure chamber 21, a direct deviation will happen sideward in the paper width direction in the position of pressing the vibration film 11*a*2. Therefore, when the piezoelectric element 12*b* is driven, in the part of the vibration film 11*a*2 facing the pressure chamber 21, a bias is more likely to arise in displacement between one side and the other side in the paper width direction. However, in this embodiment, the island-like residual portion 17 is formed in the partition wall overlapping part 15 of the piezoelectric layer 12*b*2 overlapping in the vertical direction with the partition wall 11*a*1. This position between the island-like residual portion 17 and the vibration film 11*a*2 will not deviate even if an attaching deviation arises between the protective plate 13 and the piezoelectric actuator 12. On this occasion, between the partitioning wall 13*e* and the island-like residual portion 17 of the piezoelectric actuator 12, for example, even if some of the attaching deviation occurs in the paper width direction, because the partitioning wall 13*e* is pressed on the island-like residual portion 17 of the piezoelectric actuator 12, the position of the vibration film 11*a*2 being pressed via the island-like residual portion 17 is also less likely to deviate. Therefore, in the part of the vibration film 11*a*2 facing the piezoelectric actuator 12, the bias is less likely to arise in displacement between one side and the other side in the paper width direction, such that variation in the displacement of the piezoelectric element 12*b* is also less likely to occur.

Note that if a part corresponding to the island-like residual portion 17 is formed in the recess but not formed by way of removing part of the piezoelectric layer 12*b*2 (the part forming the recess 16), then after the recess is formed in the piezoelectric layer 12*b*2, another process is needed so that the manufacturing process will be complicated. Further, if a part corresponding to the partitioning wall 3*e* of the protective plate 13 is formed in the recess 16 or on the island-like residual portion 17, then another process is needed so that the manufacturing process will be complicated.

The partitioning wall 13*e* is attached on the island-like residual portion 17 of the piezoelectric actuator 12 with the adhesive 14. By virtue of this, the partitioning wall 3*e* is less likely to come apart or deviate from the piezoelectric actuator 12. Hence, it is possible to reliably press the vibration film 11*a*2.

Further, on the partitioning wall 13*e*, the outer part 13*e*3 of the lower surface 13*e*1 is attached on the outer part of the piezoelectric layer 12*b*2 on the outside of the recess 16 in the conveyance direction with the adhesive 14. By virtue of this, the outer part 13*e*3 of the lower surface 13*e*1 of the partitioning wall 13*e* can be attached to the piezoelectric actuator 12 such that it is possible to effectively press the vibration film 11*a*2.

In this embodiment, the auxiliary electrode layer 12*c* has two belt-like auxiliary electrode layers 12*c*1 and a plurality of island-shaped auxiliary electrode layers 12*c*2. Consider that the two belt-like auxiliary electrode layers 12*c*1 are formed whereas the island-shaped auxiliary electrode layers 12*c*2 are not formed, and the outer part 13*e*3 of the lower surface 13*e*1 of the partitioning wall 13*e* is pressed on the outer part of the piezoelectric actuator 12 on the outside of the recess 16 of the piezoelectric layer 12*b*2 in the conveyance direction. In this case, an interspace is more likely to appear between the central part 13*e*2 of the lower surface 13*e*1 and the island-like residual portion 17 of the piezoelectric actuator 12. In this embodiment, however, because the island-shaped auxiliary electrode layers 12*c*2 are formed on the island-like residual portion 17, the height over the island-like residual portion 17 of the piezoelectric actuator 12 is less likely to be lower than the surroundings. Therefore, the interspace between the partitioning wall 13*e* and the island-like residual portion 17 of the piezoelectric actuator 12 is less likely to arise such that the partitioning wall 13*e* is more readily pressed on the island-like residual portion 17 of the piezoelectric actuator 12. As a result, the vibration film 11*a*2 is also more readily pressed.

The lower surface 13*e*1 is formed with a plurality of ditches 13*f*. By virtue of this, it is possible to restrain excessive adhesive from flowing out to the surroundings when the partitioning wall 13*e* is attached to the piezoelectric actuator 12 with the adhesive 14. Further, the plurality of ditches 13*f* extend in the paper width direction and are arrayed in the conveyance direction. By virtue of this, when the piezoelectric elements 12*b* are driven, it is possible to further restrain the excessive adhesive from flowing out to the surroundings when the partitioning wall 13*e* is attached to the piezoelectric actuator 12 with the adhesive 14.

Because the part of the protective plate 13 overlapping in the vertical direction with the island-like residual portion 17 is the partitioning wall 13*e* projecting downward, the protective plate 13 is more readily separated from the part of the piezoelectric actuator 12 overlapping with the pressure chamber 21. Therefore, when the piezoelectric element 12*b* is driven, the protective plate 13 is less likely to affect the piezoelectric elements 12*b* through contact, such that it is possible to suppress impeding the displacement of the piezoelectric elements 12*b*.

The island-like residual portion 17 is similar to the recess 16 in outer circumferential shape on the upper surface of the piezoelectric layer 12*b*2. By virtue of this, it is possible to have an equal difference in allowance for the attaching deviation for both directions (horizontal directions) between the lower surface 3*e*1 and the central part 13*e*1 of the partitioning wall 13*e*, even if some of the attaching deviation arises in the protective plate 13.

The recess 16 is shaped into a hexagon in outer circumference having two parallel sides in the conveyance direction. In this manner, by forming the recess 16 in each partition wall overlapping part 15 overlapping in the vertical direction with the partition wall 11*a*1 of the piezoelectric layer 12*b*2, it is possible to secure the quality of spring (the displacement) of the active part of the piezoelectric element 12*b*. Then, with the recess 16 being shaped into a hexagon in outer circumference, reactive force is less likely to be concentrated on the angular part of the ends on both sides in the conveyance direction, such that it is possible to suppress decrease in the rigidity of the piezoelectric layer 12*b*2.

Hereinabove, an embodiment of the present disclosure was explained. However, the present disclosure is not limited to the above embodiment but can undergo various changes or modifications without departing from the scope set forth in the appended claims.

In the above embodiment, the partitioning wall 13*e* of the protective plate 13 is attached on the island-like residual portion 17 of the piezoelectric actuator 12 with the adhesive 14. However, the partitioning wall 13*e* may be pressed there only by way of contact without using the adhesive 14. Further, the protective plate 13 may be formed without the partitioning wall 13*e* projecting downward. In such a case, the part of the protective plate 13 overlapping in the vertical direction with the island-like residual portion 17 may be pressed on the island-like residual portion 17 of the piezoelectric actuator 12.

Further, the island-like residual portion 17 may have a larger or smaller thickness than the piezoelectric layer 12*b*2.

Further, the piezoelectric actuator 12 is formed with the island-shaped auxiliary electrode layers 12*c*2 on the island-like residual portions 17 as auxiliary electrodes. However, the island-shaped auxiliary electrode layers 12*c*2 may not be formed. Then, if the parts of the piezoelectric actuator 12 on the island-like residual portions 17 are lower than the parts interposing the former parts in the conveyance direction, then it is desirable for the central parts 13*e*2 of the lower surface 13*e*1 of the partitioning wall 13*e* to project downward from the outer parts 13*e*3 as much as just that difference in height. Further, the protective plate 13 may have the central parts 13*e*2 of the lower surface 13*e*1 only. That is, the protective plate 13 may be just pressed on the island-like residual portion 17 of the piezoelectric actuator 12.

Further, the lower surface 3*e*1 of the partitioning wall 13*e* may be formed without the ditches 13*f*. Further, the ditches formed in the lower surface 13*e*1 may extend in a direction intersecting the paper width direction.

The width W2 of the lower surface 13*e*1 may be smaller than the width W1. Further, the island-like residual portion 17 may be shaped to have an outer circumference not similar to that of the recess 16. Further, the recess 16 may be shaped to have an outer circumference other than a hexagon.

Further, in the above description, the examples were taken by applying the present disclosure to a line head. However, without being limited to that, it is possible to apply the present disclosure to a so-called serial head which is mounted on a carriage to move together with the carriage while discharging an ink from a plurality of nozzles.

Furthermore, the present disclosure is not limited to an application to an ink jet head discharging an ink from nozzles. It is possible to apply the present disclosure to liquid discharge heads other than ink jet heads, discharging other types of liquid than inks.

What is claimed is:

1. A liquid discharge head comprising:

a pressure chamber plate including a plurality of pressure chambers aligned in one direction, and a vibration film located at one side in a thickness direction orthogonal to the one direction and covering the plurality of pressure chambers;

a piezoelectric actuator located on a surface of the vibration film at the one side in the thickness direction, and including a plurality of piezoelectric elements overlapping with the plurality of pressure chambers in the thickness direction; and a protective plate located on a surface of the piezoelectric actuator at the one side in the thickness direction, and covering the plurality of piezoelectric elements, wherein the plurality of piezoelectric elements includes a piezoelectric layer extending in the one direction, the piezoelectric layer being common to the plurality of pressure chambers, wherein the piezoelectric layer includes a circular recess and an island-like residual part which are located in a portion of the piezoelectric layer overlapping with partition walls in the thickness direction, each of the partition walls being located between the pressure chambers in the pressure chamber plate, wherein the circular recess opens at the one side in the thickness direction, the piezoelectric layer in the thickness direction is removed in the circular recess, and the circular recess surrounds the island-like residual part, and wherein an overlapping portion of the protective plate overlapping with the island-like residual part in the thickness direction is attached on the island-like residual part, a thickness of the piezoelectric layer at the island-like residual part is greater than a thickness of the piezoelectric layer at the circular recess.

2. The liquid discharge head according to claim 1, wherein the overlapping portion of the protective plate is attached on the island-like residual part of the piezoelectric actuator via an adhesive.

3. The liquid discharge head according to claim 2, wherein in an orthogonal direction orthogonal to the thickness direction and to the one direction, the overlapping portion of the protective plate is longer than the circular recess; and an outside part, at the outside of the part of the overlapping portion of the protective plate overlapping in the thickness direction with the island-like residual part, is attached to an outside part of the piezoelectric actuator on the outside of the circular recess of the piezoelectric layer.

4. The liquid discharge head according to claim 1, wherein an auxiliary electrode is located on the island-like residual part.

5. The liquid discharge head according to claim 1, wherein the protective plate is separated from a part of the piezoelectric actuator overlapping with the pressure chambers in the thickness direction.

6. The liquid discharge head according to claim 2, wherein the protective plate includes a ditch configured to flow the adhesive away, the ditch being located on an attachment surface of the protective plate attached to the piezoelectric actuator.

7. The liquid discharge head according to claim 6, wherein the ditch is one of a plurality of ditches, wherein the plurality of ditches extend respectively along the one direction, and wherein in the attachment surface, the plurality of ditches are arranged side by side in an orthogonal direction orthogonal to the thickness direction and to the one direction.

8. The liquid discharge head according to claim 1, wherein the overlapping portion of the protective plate projects to another side in the thickness direction farther than the part of the protective plate overlapping in the thickness direction with the pressure chamber plate.

9. The liquid discharge head according to claim 8, wherein the overlapping portion of the protective plate is wider than the island-like residual part in the one direction.

10. The liquid discharge head according to claim 1, wherein the island-like residual part is similar to the circular recess in outer circumferential shape on the surface of the piezoelectric layer at the one side.

11. The liquid discharge head according to claim 10, wherein the circular recess includes an outer circumferential shape of a hexagon having two sides parallel to an orthogonal direction orthogonal to the thickness direction and to the one direction.

12. A liquid discharge head comprising:

a pressure chamber plate including a plurality of pressure chambers aligned in one direction, and a vibration film located at one side in a thickness direction orthogonal to the one direction and covering the plurality of pressure chambers;

a piezoelectric actuator located on a surface of the vibration film at the one side in the thickness direction, and including a plurality of piezoelectric elements overlapping with the plurality of pressure chambers in the thickness direction; and a protective plate located on a surface of the piezoelectric actuator at the one side in the thickness direction, and covering the plurality of piezoelectric elements, wherein the plurality of piezoelectric elements includes a piezoelectric layer extending in the one direction, the piezoelectric layer being common to the plurality of pressure chambers, wherein the piezoelectric layer includes a plurality of circular recesses and a plurality of island-like residual parts which are located in a portion of the piezoelectric layer overlapping with partition walls in the thickness direction, each of the partition walls being located between the pressure chambers in the pressure chamber plate, wherein each of the circular recesses opens at the one side in the thickness direction, at least part of the piezoelectric layer in the thickness direction is removed in each of the circular recesses, and each of the circular recesses surrounds one of the island-like residual parts so that the plurality of the island-like residual parts are separated from each other, and wherein an overlapping portion of the protective plate overlapping with the island-like residual part in the thickness direction is attached on the island-like residual part, a thickness of the piezoelectric layer at the island-like residual part is greater than a thickness of the piezoelectric layer at the circular recess.

* * * * *